US005211819A

United States Patent [19]

Hu

[11] Patent Number: 5,211,819

[45] Date of Patent: May 18, 1993

[54] MICRO-EFFLUENT PROCESS FOR RINSING WATER IN INDUSTRIAL PROCESSING

[75] Inventor: Dezhong Hu, Xuzhou, China

[73] Assignees: Ailan Ge; Hubei Machinery & Equipment Import & Export Corporation, both of China

[21] Appl. No.: 810,296

[22] Filed: Dec. 19, 1991

[30] Foreign Application Priority Data

Dec. 26, 1990 [CN] China ..... 90106085.2

[51] Int. Cl.[5] ..... C02F 9/00; C02F 1/00

[52] U.S. Cl. ..... 204/149; 204/DIG. 13; 204/152

[58] Field of Search ..... 204/149, 152, DIG. 13

[56] References Cited

U.S. PATENT DOCUMENTS

| | | | |
|---|---|---|---|
| 3,658,470 | 4/1972 | Zievers et al. | 204/DIG. 13 X |
| 3,681,212 | 8/1972 | McKissick | 204/DIG. 13 X |
| 4,197,167 | 4/1980 | Wright, Jr. | 204/DIG. 13 X |
| 4,595,474 | 6/1986 | Greco | 204/DIG. 13 X |
| 4,746,414 | 5/1988 | Carpenter et al. | 204/DIG. 13 X |
| 4,781,806 | 11/1988 | Tenace et al. | 204/DIG. 13 X |

*Primary Examiner*—Donald R. Valentine

*Attorney, Agent, or Firm*—Roylance, Abrams, Berdo & Goodman

[57] ABSTRACT

This invention relates to a micro-effluent process for rinsing water and equipment for the same in industrial processing, especially in electroplating processing. The process of the present invention is characterized in that periodically tank-turning over, that is, at definite time intervals, the rinsing solution is transferred from the first rinse tank to a high level storage tank or to a working-tank (plating-tank), from the second rinse tank to the first rinse tank, and so on and so forth, at last from the last rinse tank to its preceding tank, and the empty last rinse tank is filled up by clean water with a flow rate of less than 400 l/h, or filled up with clean water periodically at a definite time interval same as that for tank-turning over. According to the present invention, the rinsing water overflowed from the last rinse tank can be discharged directly, the cleaning quality of work-pieces accords with requirement, the recovery of the plating solution is maximized, and the water consumption is greatly reduced. This invention is also applied widely in other rinsing processes, such as in printing-dyeing industry and butcher business and so on.

18 Claims, 5 Drawing Sheets

MICRO-EFFLUENT PROCESS FOR RINSING WATER IN INDUSTRIAL PROCESSING

FIELD OF THE INVENTION

The present invention relates to a micro-effluent process for rinsing water and equipment for the same in industrial processing, especially in electroplating processing.

According to the present invention, rinse tanks are turned over periodically to replenish the electroplating tank with the rinsing solution from the first rinse tank which contains the highest concentration of electroplating solution among all rinse tanks for making a maximized recovery and reuse of electroplating solution. The rinsing solution in the last rinse tank can be directly discharged and meet the requirements of effluent regulation without any further waste water treatment.

BACKGROUND OF THE INVENTION

The discharge of rinsing solution in industrial processing especially in the electroplating processing, without any treatment, will cause serious environmental pollution, and hence is extremely harmful for human being and nature.

In recent years, on the one hand, technology revolution for electroplating promotes wide-range utilization of non-cyanide electroplating, low-chromium or non-chromium passivation, low concentration chromium plating, etc., thus reduces the extremely poisonous materials in rinsing water, but the waste water effluent still can not meet the requirement of effluent regulation. On the other hand, the treatment of the electroplating waste water by chemical and ion-exchange methods and corresponding equipments have been widely adopted in the world to reduce the concentration of poisonous materials to an allowable range.

However, in electroplating processing, each type of plating will produce about 1000 l/h waste water. Large quantity of waste water needs to be treated especially for those plants which conduct long period electroplating operation and multi-type plating operation.

In some plants the quantity of waste water amounts to tens thousand tons each month. At present, the electroplating waste effluent is strictly controlled in many countries, therefore, a large number of equipments for treating waste water is required, which corresponds an investment 1 to 1.2 times as much as that for electroplating processing line. Such a high investment for waste water treatment equipments makes it difficult to conduct electroplating processing not only for small plants but also for middle-scale plants. U.S. Pat. No. 4,595,474 disclosed a "Recovery System of Electroplating Solution". Based on the principle of siphonage, the liquid in rinse tank is transferred to the plating tank to make up the gradually decreased quantity of plating solution in the plating tank and to maintain the liquid level balance between plating tank and rinse tank, hence partially recovers the plating solution, reduces the concentration of poisonous materials in rinsing water effluent from the last rinse tank, and reduces the cost for the waste water treatment. Comparing with the traditional plating technology, this method is more or less effective in recovering plating solution and reducing the volume of waste water to be treated. However, in the electroplating process using such a system, the evaporation and consumption amount of plating solution and the recovery amount from rinse tank are hardly to balance between each other and a large quantity of waste water is still produced, which needs further treatment before discharge. The only advantage is that the volume of waste water to be treated is more or less reduced. The investment for treatment equipments and operating cost remain at high levels. Two main deficiencies can be summarized from that prior art as follows: firstly, the quantity of rinsing water for each type of plating is more than 500 l/h; secondly, the plating waste water still needs to be treated with waste water treating equipments.

In short, the prior arts has not coped with above-mentioned problems very successfully.

OBJECTS OF THE INVENTION

One object of the present invention is to provide a micro-effluent process for rinsing water and equipment for the same in industrial processing in order to solve the problems remained in the prior arts. According to the present invention, the rinsing solution of the last rinse tank can meet the requirement of effluent regulation without any treatment by special equipments, the effluent amount can be lower than 400 l/h. At its best, no waste water is discharged.

Another objects of the present invention is to provide a process to maximize the recovery and reuse of plating solution, to greatly reduce the water consumption in plating processing, and to essentially eliminate the environment pollution caused by waste water from electroplating.

A further object of the present invention is to provide equipment for the process of the present invention.

SUMMARY OF THE INVENTION

The present invention relates to a micro-effluent process for rinsing water and equipment for the same in industrial processing, especially in electroplating processing.

The process of the present invention comprises following steps:

rinsing work-pieces produced in a working-tank in a rinsing line which contains 4–7 rinse tanks, a high level storage tank placed above the working-tank;

turning over periodically the above-mentioned rinse tanks in such a way that the rinsing solution in the first rinse tank is transferred completely into said high level storage tank or partially into said working-tank, the rinsing solution in the second rinse tank is transferred completely or partially into the first rinse tank, and so on and so forth, the rinsing solution in the last rinse tank is transferred into its preceding rinse tank to fill it up;

adding clean rinsing water into the last rinse tank continuously or intermittently according to the period of turning over said rinse tanks to fill it up with clean rinsing water;

directly discharging the rinsing solution overflowed from the last rinse tank.

The equipment for implementing the process of the present invention includes four to seven rinse tanks and one high-level storage tank which is placed above the working-tank. In each rinse tank a compressed air (oil free and water free) stirring unit is installed. If necessary, a self-spray device can be installed both in the first and the second rinse tanks. A steam heating unit is installed in the high-level storage tank. Soft plastics is used for interconnection between the working-tank and the first rinse tank and between other rinse tanks. A filter is installed between the first rinse tank and the high-level storage tank or working-tank. A pump is installed between each two adjacent rinse tanks.

DETAILED DESCRIPTION OF THE INVENTION

Figure 1:
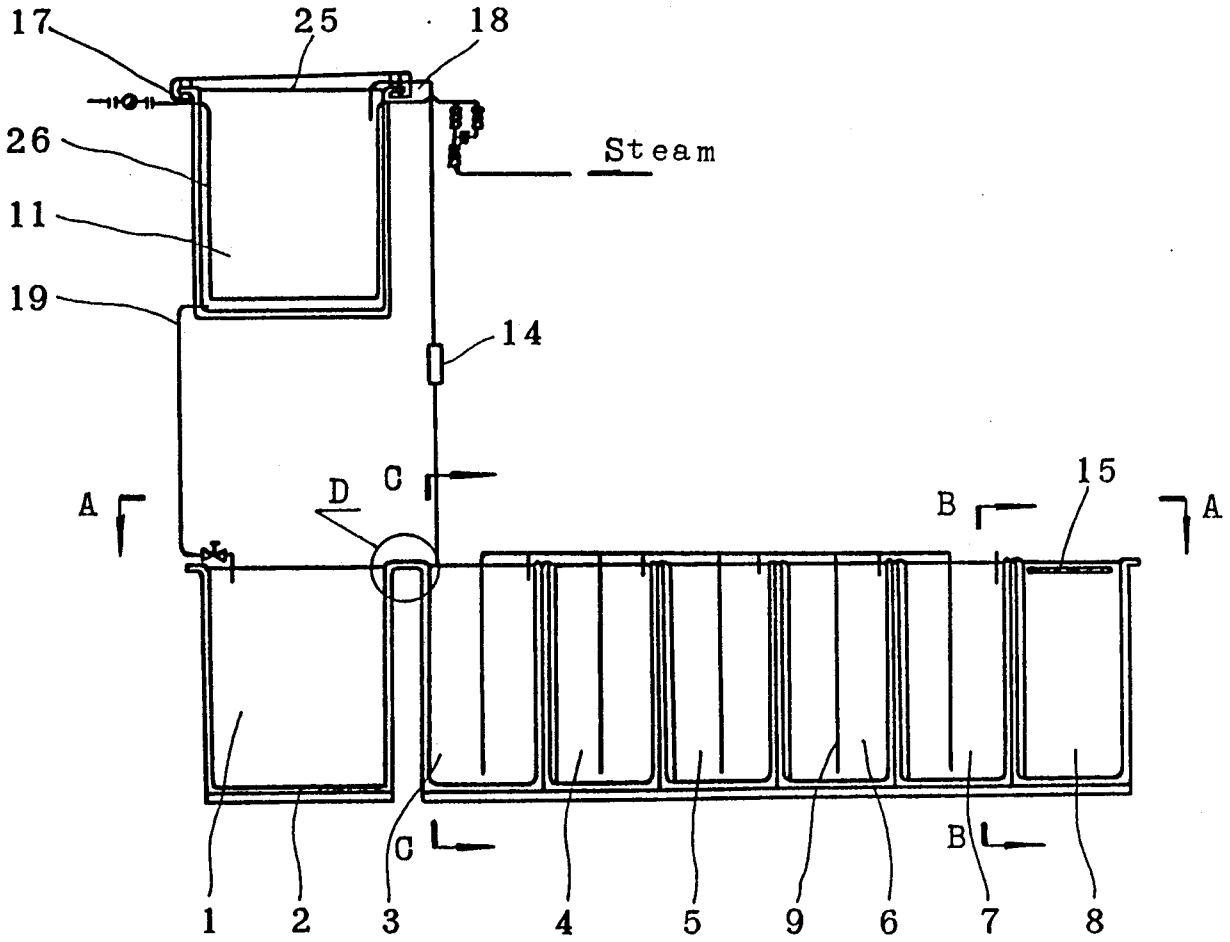
FIG. 1 is a schematic drawing of micro-effluent process for rinsing solution and equipment for the same in electroplating processing.
Figure 2:
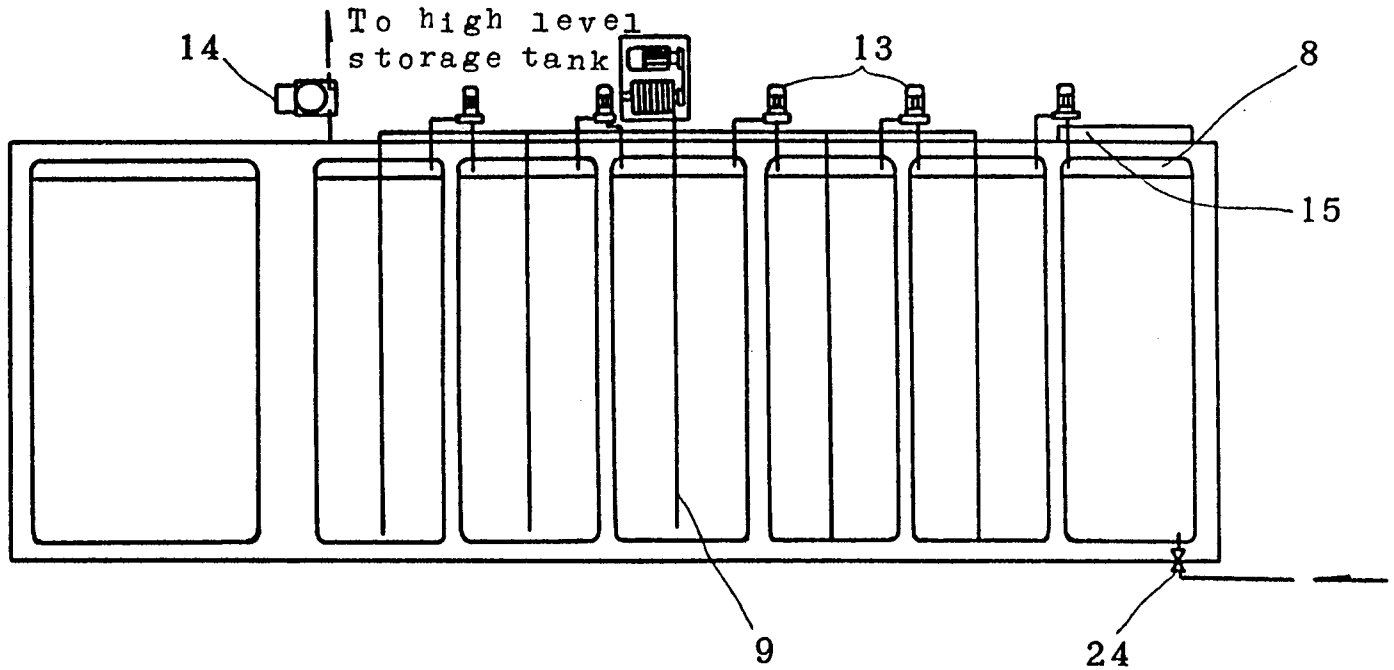
FIG. 2 is a cross section taken along line A—A of FIG. 1.
Figure 3:
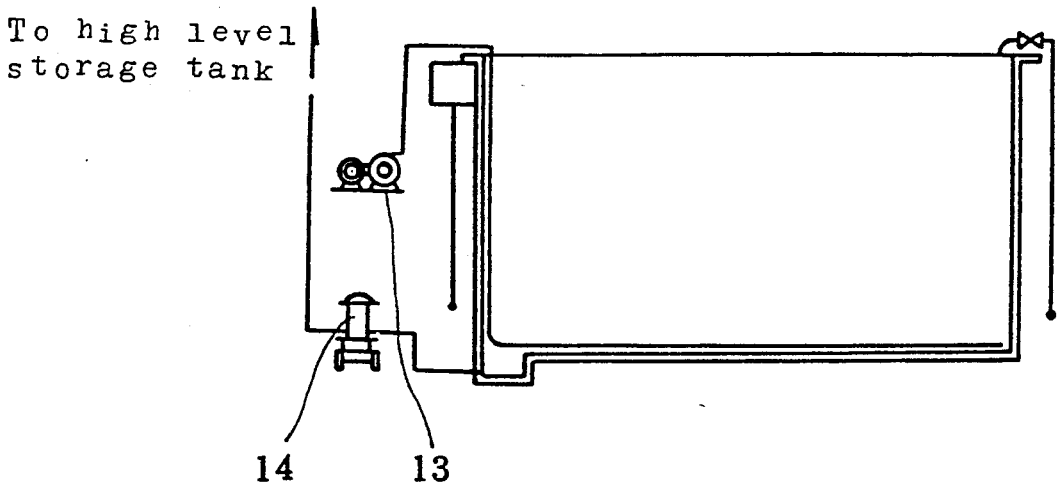
FIG. 3 is a cross section taken along line C—C of FIG. 1.
Figure 4:
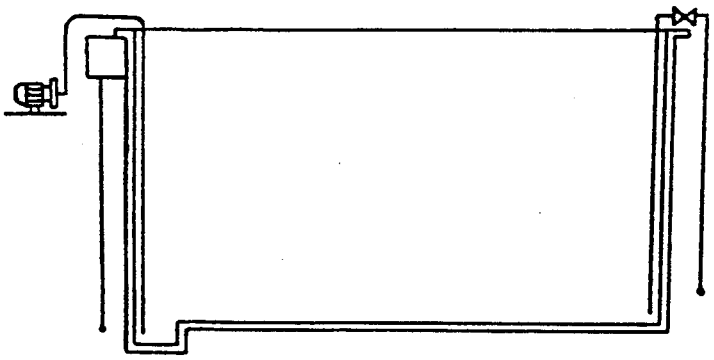
FIG. 4 is a cross section taken along line B—B of FIG. 1.
Figure 5:
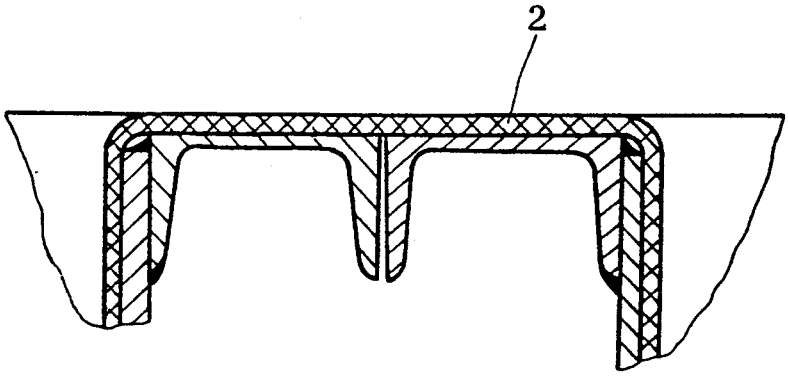
FIG. 5 is the D-partial diagrammatic view of FIG. 1.

The present invention relates to micro-effluent process for rinsing water and equipment for the same in industrial processing, especially in electroplating processing.

The micro-effluent process for rinsing water in industrial processing of the present invention comprises the following steps:

rinsing work-pieces produced in working-tank 1 (or plating-tank) in a rinsing line which contains 4–7 rinse tanks and one high level storage tank 11 placed above the tank 1;

turning over periodically the above-mentioned rinse tanks in such a way that the rinsing solution in the first rinse tank 3 is transferred completely into said high level storage tank 11 or partially into said working-tank 1, the rinsing solution in the second rinse tank is transferred completely or partially into the first rinse tank, and so on and so forth, the rinsing solution in the last rinse tank is transferred into its proceeding rinse tank to fill it up;

adding clean rinsing water into the last rinse tank continuously or intermittently according to the period of turning over said rinse tanks to fill it up with clean water;

directly discharging the rinsing solution overflowed from the last rinse tank.

According to the process of the present invention, compressed air (oil free and water free)is introduced into the above mentioned rinse tanks by the compressed air stirring units installed therein. During rinsing operation, the compressed air introduced make the rinsing solution in the rinse tanks flushing and rinsing the work-pieces thoroughly and effectively, and also homogenize the concentration of rinsing solution quickly.

In an embodiment of the present invention, the rinsing line contains 6 rinse tanks, i.e., tanks 3–8, a high level tank 11, a compressed air stirring unit 9 is installed in each one of said rinse tanks, a soft plastics 2 is paved inside each of said rinse tanks and connected with the plating-tank 1, and the gap between each two adjacent rinse tanks and the gap between the first rinse tank and the plating-tank 1 can be covered with the plastics for preventing the poisonous plating solution dropping down onto the floor, a pump 13 is installed between each pair of adjacent rinse tanks and between tank 1 and tank 3 for pumping the rinsing solution from one rinse tank to its preceding tank, a filter 14 is installed between the first rinse tank 3 and the high-level storage tank 11. If the harmful materials in electroplating solution is in a high concentration, a self-spray device is installed in the first and the second rinse tanks separately to speed up the homogenization of rinsing solution to remedy the insufficiency of air stirring. The work-pieces are sprayed by rinsing solution in these two rinse tanks, making the adhered solution on work-pieces having concentration as close as possible to that of rinsing solution in the rinse tanks.

After the plating and rinsing operation have been conducted for a period, which lasts 6–12 full days on the basis of a conventional design, the rinse tanks are turned over, The rinsing solution in the first rinse tank 3 is pumped through the filter 14 into the high-level storage tank 11 completely, the rinsing solution in the second rinse tank 4 is transferred fully into the first tank 3 by pump 13, and so on and so forth, finally the rinsing solution in the last rinse tank 8 is transferred into its preceding rinse tank 7. The last rinse tank 8 is a water constantly flowing tank, clean rinsing water flows continuously with a constant speed passing through the central part 24 of the tank bottom, the spilled rinsing solution flows out constantly from an overflowing outlet 15 on the upper left side of the tank, and is discharged directly into the sewer. The flow rate of the discharged water is about 4 to about 400 l/h, preferably is about 20 to about 200 l/h. Clean rinsing water can also be added into the last rinse tank intermittently according to the period of turning over said rinse tanks.

In the next period of plating and rinsing operation, according to the consumption of plating solution the rinsing solution conformed to the requirement of the plating solution in the high-level storage tank 11, is in turn replenished into the plating tank 1 timely and gradually to supplement the consumption of plating solution of plating tank 1 during production. In this period, the rinsing solution transferred into the high-level storage tank 11 in the preceding period will be just used up completely.

According to the process of the present invention, the retention time of work-pieces in the first rinse tank 3 is taken as a production meter. Herein, "a production meter" means the time used for producing a product in the working tank. In this way, a continuous process of plating and rinsing can be maintained, while more plating solution brought out by work-pieces is retained in the first rinse tank 3 and the work-pieces will be thoroughly cleaned.

According to inventor's superposition principle, the concentration of plating solution in rinse tanks decreases sequentially along with the series of rinse tanks. By using the process of the present invention, the work-pieces can be cleaned very effectively in each rinse tank. Therefore, from the first rinse tank to the last rinse tank, the progressive decrease of the concentration of plating solution in the series of rinse tanks becomes more significantly. That is to say, the concentration of plating solution in the first rinse tank is very high, whereas the concentration in the last tank 8 is very low, when the cleaning water is supplied continuously at a flow rate of about 4 to about 400 l/h, preferably at about 20 to about 200 l/h, the content of harmful materials in the rinsing solution overflowed from the last rinse tank can be lower than the requirement of effluent regulation ($<0.5$ mg/l), then can be discharged directly. The flow rate for introducing clean rinsing water is determined on the basis of overall balance of multiple factors, such as the concentration of plating solution, the volume and number of rinse tanks, the number of times of plating and rinsing per hour, the quantity of plating solution brought out by each work-piece from plating tanks, etc.

According to the process of the present invention, the rinsing solution introduced into the high-level storage tank 11 must be transferred completely into the plating tank 1 in a production and rinsing period. In this way, the rinsing solution in the first rinse tank 3 can be transferred completely into tank 11 in the next turning over operation. The amount of rinsing solution in high-level storage tank 11 transferred into plating tank 1 each time and the time interval of the transfer operations are decided by the consumption rate of plating solution of plating tank 1. In general, the rate for replenishing the rinsing solution from tank 11 to plating tank 1 equals to the consumption rate of plating solution in plating tank 1 to maintain a constant liquid level in plating tank 1.

The consumption of plating solution in plating tank 1 is ascribed to the evaporation loss during plating and adhesive loss by work-pieces. The evaporation loss of plating solution is predominant. In order to balance the consumption amount of plating solution and the replenishing amount of rinsing solution, according to the present invention, a steam heating unit 26 is installed in the high-level storage tank 11. When the temperature of plating tank 1 is lower than 40° C., the evaporation amount of plating solution in the plating tank 1 becomes less, thus, the rinsing solution in tank 11 can not be transferred completely to the plating tank 1 in a plating and rinsing period. Under this circumstances, the solution in the high-level storage tank 11 should be heated to 50° to 55° C. by the steam heating device 26 installed in tank 11 to increase the evaporation amount and decrease the amount of solution in the high-level tank storage 11. When the temperature of plating tank 1 is higher than 40° C., the liquid evaporation in the plating tank 1 becomes faster, the rinsing solution in the high-level storage tank 11 can be transferred completely into plating tank 1 in a plating-rinsing period, and keep a constant liquid level in the plating tank 1. In this case, there is no need to heat the rinsing solution in the tank 11.

According to the process of the present invention, before the rinsing solution in the first rinse tank 3 is transferred into the high-level storage tank 11, it must be filtered to remove the impurities for meeting the requirement of plating solution.

Another way to implement the present invention is the direct transfer of part of the rinsing solution, from the first rinse tank 3 into the plating-tank 1, from the second rinse tank 4 into the tank 3, and so on and so forth, and finally from the last rinse tank 8 into its preceding rinse tank 7. Clean rinsing water is added to the last rinse tank at a flow rate of about 4 to about 400 l/h, preferably at a flow rate of about 20 to 200 l/h. The content of harmful materials in rinsing solution overflowed from the last rinse tank is lower than the requirement of effluent regulation, hence it can be discharged directly. Before the rinsing solution in the first rinse tank 3 is transferred into the plating-tank 1, it must be filtered by a filter unit 14.

According to a preferred embodiment of the process of the present invention, according to the tank-turning over period, clean water, distilled water or deionized water is added to the last empty rinse tank 8, hence there is no need to maintain a constant flowing water in the last rinse tank 8. In this case, because the rinsing water in rinse tank is completely recovered for reuse, therefore, no rinsing waste water will be discharged. That means a complete elimination of the environment pollution caused by industrial rinsing waste water is achieved.

Another embodiment of the process of the present invention is that only the rinsing solution in the first rinse tank 3 is chemically treated to recover high value raw materials and harmful materials, rather than recycling to the plating tank, the remaining liquid can be discharged if it satisfies the requirement of effluent regulation. The advantage of this method is that only the rinsing water in the first rinse tank needs to be treated, hence the waste water treatment volume is greatly reduced and the water consumption in electroplating is minimized.

According to the process of the present invention, the plating solution brought out by work-pieces into rinse tanks is basically recovered for reuse. On the one hand, the effluent of rinsing waste water is greatly decreased or completely eliminated, therefore the water consumption is greatly reduced; on the other hand, since the rinsing solution in the last rinse tank can be directly discharged without any treatment, hence the investment for waste water treatment equipments and the operating cost are greatly reduced and the economic effectiveness of electroplating is greatly increased. In addition, the product cleaning quality satisfies with the requirement.

The equipment for implementing the process of the present invention comprises 4–7 rinse tanks and a high-level storage tank 11 located above plating-tank 1 (working-tank), as shown in FIG. 1. The high-level storage tank 11 and rinse tanks are manufactured by same materials, the former has a volume about 2.5 times as large as that of each rinse tank or about 1.2 times as large as that of or slightly more than that of the plating tank 1. Each rinse tank has the same volume. The high-level storage tank 11 is an open vessel with a bevel cover 25. The bevel angle between cover 25 and horizontal plane is about 12°. The cover 25 is made of PVC plastics and is supported by four pillars with two different heights, which are welded on the top of the storage tank 11. The difference of the heights of the pillars determines the angle between the cover and the top level of the tank 11. There are eaves 17 round the cover extending downward to a position slightly lower than the top of the storage tank 11 to prevent the falling of dust and other impurities into tank 11. The cover 25 is then fixed in a inclined position making tank 11 half open to the air. Vapor can escape from tank 11, while condensed liquid drop on the cover 25 slide down along the inclined cover to avoid the possibility of returning back to the storage tank 11. A steam heating device 26 is installed in the tank 11. A liquid inlet tube 18 is located in the upper part of the storage tank 11, and an outlet tube 19 is in the lower part of the tank. The mentioned inlet tube 18 is connected to the first rinse tank 3 and is controlled automatically by a electromagnetic valve. The outlet tube 19 is connected to the plating tank 1. All rinse tanks are put together closely. Soft plastics 2 or other corrosion-resistant materials are used to connect those rinse tanks and to connect the first rinse tank 3 with plating tank 1, preventing the contamination of workshop floor caused by plating solution drop during transferring work-pieces from one tank to the other tank. In this way, there is no need to apply anti-corrosion treatment to the floor of plating workshop by using the process of the invention. The above mentioned soft plastics can be PVC having a thickness of about 3–6 mm. It is paved on the inner walls of the plating tank 1 and each rinse tank. After the inner side of one tank has been paved, the soft plastic material stride over the top edges of two closely placed tanks, then the inner side of the next tank will be paved. The operation repeated continuously until the last tank 8 is also paved. In this way, the gap between two closely placed tanks is covered by soft plastics, preventing the floor contamination by plating solution dropping outside the tank.

Figure 6:
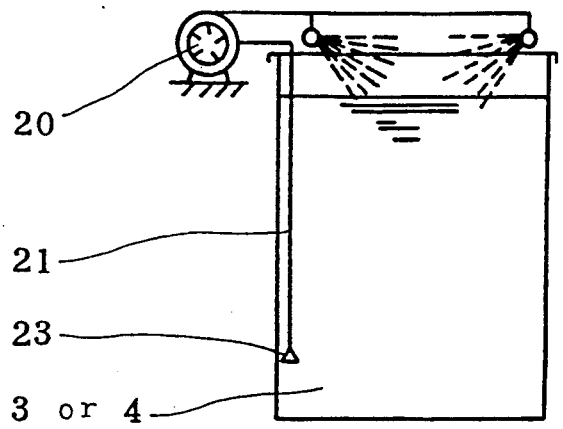
FIG. 6 is a front view of self-spray device in the first and second rinse tanks.
Figure 7:
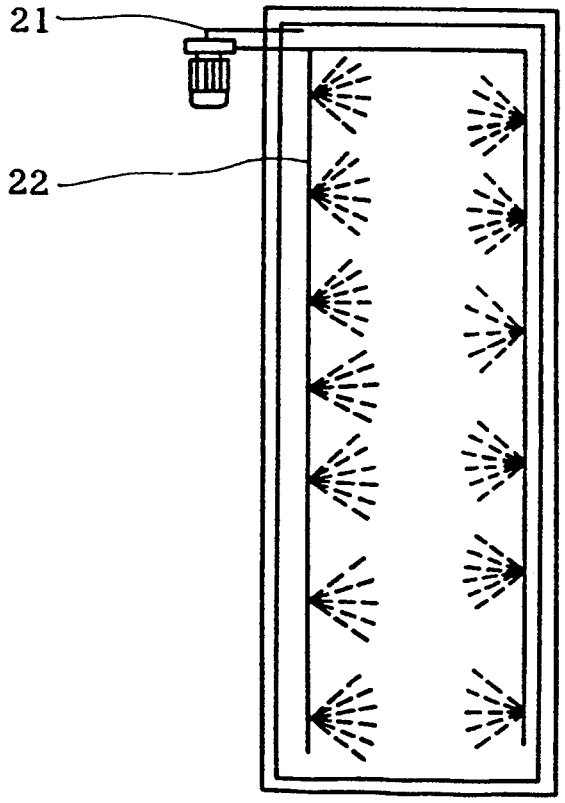
FIG. 7 is a vertical view of self-spray device in the first and second rinse tanks.

According to the present invention, a compressed air stirring unit 9 is installed in each rinse tank. The rinsing solution is stirred by the compressed air (oil-free, water-free) delivered by this unit 9, making a homogeneous solution, reducing the quantity of the plating solution brought out by work-pieces, and also flushing the work-pieces to improve cleaning efficiency. A self-spray device can be installed in the first rinse tank 3 and the second rinse tank 4 separately as shown in FIGS. 6 and 7, if necessary. The mentioned spray device includes a water pump 20, water inlet tube 21, water filter net 23, and water spray tube 22. The work-pieces are sprayed and flushed at a position above the liquid level in the tank by rinsing solution drawn from the rinse tank by a pump 20. A filter unit 14 is installed in the tube connecting the first rinse tank 3 and the high-level storage tank 11 to prevent the harmful sediment or suspension materials in rinsing solution from entering the tank 11, protecting the purity of plating solution. A pump 13 is installed between each two adjacent rinse tanks for transferring the rinsing solution from one rise tank into its preceding rinse tank. In this way, the tank-turning over can be operated automatically, and the investment for equipment can be reduced. There is a water inlet 24 at the bottom of the last rinse tank 8. The inlet water flow is controlled by a valve. A water outlet 15 with connecting tube is located on the left upper part of the tank 8, through which overflowed rinsing water from tank 8 is discharged into sewer directly.

By using the process and equipment of the present invention, the floor of the plating workshop will be dry, the appearance of the conventional plating workshop with moist and damp floor will be changed, and the operating environment will be improved.

According to the present invention, the rinsing solution produced in the electroplating processing can be discharged directly without treatment and no treatment equipment is needed, and the effluent volume can be less than about 400 l/h. It has not only saved large quantity of water in plating processing while meeting the requirement for cleaning quality, but also reduced the harmful materials in discharged water to a concentration lower than that specified in effluent regulation without employment of the currently-used expensive equipments, and maximized the recovery of plating solution brought out from plating tank by work-pieces. Therefore, the cost of electroplating is minimized and the serious environment pollution caused by plating waste water as a longstanding problem has been basically resolved.

The process of the present invention can be used not only in the electroplating processing, but also can be used widely in the rinsing processes in printing-dyeing and slaughter business etc., reducing water consumption to an extent same as that in electro-plating processing, and eliminating the need for waste treatment equipments. Hence, the process of the present invention is very economically effective and very beneficial to society.

The following examples further illustrate the process of the present invention. However, it should be understood that the invention is not intended to be limited to the specific embodiments.

EXAMPLES

The cleaning of work-pieces in chromium plating processing is taken as an example to illustrate the present invention in detail. The chromic anhydride ($Cr_2O_3$) content of plating solution is 330 g/l, the plating solution brought out by each polar bar's plating materials each time is 0.0928 liter, the volume and number of water rinse tank are determined by designed conditions. The electroplating processing is conducted by three shifts. The work-pieces are produced through plating and rinsing 206 times every 24 hours. The consumption of plating solution is 90 1/24 h.

EXAMPLE 1

Six rinse tanks are used. The volume of each tank is 1080 liters. The volume of the high level storage tank is 2500 liters. Twelve days-and-nights are taken as a production-rinsing period. On each day-and-night, 206 platings are produced. After 12 days-and-nights continuous operation of plating processing line, i. e., after 2472 platings have been produced and rinsed, a whole tank-turning over is carried out. That is, the rinsing solution in the first rinse tank is pumped completely into the high-level storage tank through the filter, the rinsing solution in the second rinse tank is pumped completely into the first rinse tank, and so on and so forth, finally the rinsing solution in the sixth rinse tank is completely pumped into its preceding rinse tank. And then, deionized water or distilled water is used to refill the last tank. After that, it is ready for the next-period plating production. In the next tank-turning over period, it must replenish (at regular intervals) the plating tank with the rinsing solution in the high-level storage tank to supplement the consumption of plating solution in plating tank for keeping a constant liquid level of plating solution. The consumption rate of plating solution in plating tank is 90 liter per 24 hours. Therefore, it should replenish 90 liters rinsing solution into this tank from the high-level storage tank every 24 hours. So it just consumes 1080 liters in twelve days-and-nights. Thus the total solution in the high-level storage tank consumed completely just before the next period begins. Then another tank-turning over process will be repeated.

After a plating-cleaning production period (12 days-and nights), the concentration of plating solution in each rinse tank is as follows:

| Rinse tank | 3 | 4 | 5 | 6 | 7 | 8 |
|---|---|---|---|---|---|---|
| Concentration mg/l | 36421.73 | 4577.53 | 434.79 | 36.19 | 2.87 | 0.225 |

As mentioned above, according to the process of the present invention, the plating solution can recovered for reuse completely, no waste water is produced, the water consumption is greatly reduced, the investment for waste treatment equipment is saved, and cleaning quality satisfies the requirement.

EXAMPLE 2

Six rinse tanks are used, in which the last rinse tank has constantly flowing water with a flow rate of 72 l/h. The volume of each tank is 1080 liters. The volume of the high level storage tank is 2500 liters. Twelve days-and-nights are taken as a production-rinsing period. On each day-and-night, 206 platings are produced. After 12 days-and-nights continuous operation of plating processing line, i. e., after 2472 platings have been produced and rinsed, a whole tank-turning over is carried out. That is, the rinsing solution in the first rinse tank is pumped completely into the high-level storage tank through the filter, the rinsing solution in the second rinse tank is pumped completely into the first rinse tank, and so on and so forth, finally the rinsing solution in the sixth rinse tank is pumped into the fifth rinse tank to make it filled up, and then, clean tap water is used to refill the last tank. After that, it is ready for the next-period plating production. In the next tank-turning over period, it must replenish (at regular intervals) the plating tank with the rinsing solution in the high-level storage tank to supplement the consumption of plating solution in plating tank for keeping a constant liquid level of plating solution. The consumption rate of plating solution in plating tank is 90 liters per 24 hours. Therefore, it should replenish 90 liters rinsing solution into this tank from the high-level storage tank every 24 hours. So it just consumes 1080 liters in twelve days-and-nights. Thus the total solution in the high-level storage tank can be consumed completely just before the next period begins.

The waste water volume discharged from the last tank is 72 l/h, the chromium ($Cr^{+3}$) content in the waste water is 0.15 mg/l.

EXAMPLE 3

Five rinse tanks are used without additional high-level storage tank. The fifth tank has constantly flowing water with a flow rate of 360 l/h. In every 24 hours, 90 l rinsing solution is transferred from the first rinse tank to the plating tank through a filter, from the second rinse tank to the first, at last from the fifth to the fourth. The fifth tank is refilled by constantly flowing water with a flow rate of 360 l/h. Hence the waste waste water volume discharged is also 360 l/h. The chromium ion($Cr^{+3}$) concentration in waste water is 0.35 mg/l. The waste water can be discharged directly. The cleaning quality meets the requirement.

What is claimed is:

1. A micro-effluent process for recovering a rinsing solution in industrial electroplating processing, comprising the following steps:

rinsing work-pieces produced in a plating tank in a rinsing line comprising 4–7 rinse tanks arranged in series to successively receive the work pieces, and a high level storage tank placed above said plating tank;

transferring the rinsing solution in the first rinse tank completely into said high-level storage tank or partially transferring the rinsing solution from said first rinse tank into the plate tank, successively transferring the rinsing solution of each successive rinse tank completely or partially into the previous rinse tank until the rinsing solution in the last rinse tank is completely or partially transferred into the preceding tank;

adding clean rinsing water into the last rinse tank continuously or intermittently according to the period of transferring said rinsing solution of said rinse tanks to fill said last rinse tank with clean rinsing water; and directly discharging the rinsing solution overflowed from the last rinse tank.

2. A process according to claim 1 characterized in that the clean rinsing water added into the last rinse tank is distilled water, deionized water or tap water that accords with the requirement for electroplating.

3. A process according to claim 1 characterized in that the flow rate of clean rinsing water added to the last rinse tank is in the range of about 4–400 l/h.

4. A process in that according to claim 3 wherein the flow rate of the clean rinsing water added to the last rinse tank is 20–200 l/h.

5. A process according to claim 1 characterized in that clean rinsing water is added into the last rinse tank after the transferring step is completed.

6. A process according to claim 1 characterized in that work-pieces are flushed by the rinsing solution of the first rinse tank provided by a spray unit installed in said tank.

7. A process according to claim 1 characterized in that the work-pieces are flushed by the rinsing solution of the second rinse tank provided by a spray unit installed in said tank.

8. A process according to claim 1 characterized in that the rinsing time of work-pieces in the first rinse tank is taken as a work meter for electroplating.

9. A process according to claim 1 characterized in that rinsing solution in the high-level storage tank is transferred into the plating tank timely and in batches, and the rinsing solution in said high level storage tank is completely transferred into the plating tank in a subsequent transferring step.

10. A process according to claim 1 characterized in that during the rinsing operation in each rinse tank, oil-free and water-free compressed air is used for rinsing solution stirring.

11. A process according to claim 1 characterized in that the rinsing solution in the high -level storage tank is heated to 50°–55° C.

12. A process according to claim 1 characterized in that a compressed air stirring unit is installed in each one of said rinse tanks.

13. A process according to claim 1 characterized in that a spray unit is installed in the first rinse tank.

14. A process according to claim 1 characterized in that a spray unit is installed in the second rinse tank.

15. A process according to claim 1 characterized in that an automatic heating unit is installed in the high-level storage tank.

16. A process according to claim 1 characterized in that soft plastics are used for interconnection between said plating tank and rinse tank and between each two adjacent rinse tanks.

17. A process according to claim 1 characterized in that a filter is placed between the first rinse tank and the high-level storage tank.

18. A process according to claim 1 characterized in that a pump is placed between each two adjacent rinse tanks.

* * * * *